United States Patent [19]

Schoenberger

[11] Patent Number: 5,001,789

[45] Date of Patent: Mar. 26, 1991

[54] INVALID LIFT AND TRANSPORT APPARATUS

[76] Inventor: Luther V. Schoenberger, 10468 S.R. 293 R#1, Forest, Ohio 45843

[21] Appl. No.: 446,052

[22] Filed: Dec. 5, 1989

[51] Int. Cl.[5] ..... A61G 7/14; A61G 7/12

[52] U.S. Cl. ..... 5/81 B; 5/86

[58] Field of Search ..... 5/81 R, 81 B, 86, 83

[56] References Cited

U.S. PATENT DOCUMENTS

| | | | |
|---|---|---|---|
| 4,157,593 | 6/1979 | Kristensson | 5/81 R |
| 4,435,863 | 3/1984 | Lerich | 5/81 B |
| 4,504,988 | 3/1985 | Deutchman | 5/81 R |
| 4,545,085 | 10/1985 | Feldt | 5/81 R |
| 4,569,094 | 2/1986 | Mart et al. | 5/86 |

*Primary Examiner*—Alexander Grosz

*Attorney, Agent, or Firm*—Roger S. Dybvig

[57] ABSTRACT

For safely lifting an invalid to an elevated position in which the invalid's backside may be exposed for cleansing and in which the invalid may be transported over a floor, an invalid support assembly having a support frame with trunk, knee, and foot supports is mounted on a wheeled support for movement from a first, lower position in which an invalid in a seated orientation may be clamped to the support assembly to a second, elevated position in which the invalid is oriented in a generally prone position. Remotely controllable, battery-operated jacking units drive parts of a lever system for moving the invalid support assembly between its lower and elevated positions.

30 Claims, 2 Drawing Sheets

10
12
14
16
18
19
20
22
24
26
28
32
34
36
38
40
42
44
46
48
50
60
70
72
76
78
80
82
84
86
88
90
92
94
96
98
104
106
108
110
112
114
116
118
122
124
126
128
132
134

10
12
14
16
18
20
22
24
26
28
32
34
36
38
40
42
44
46
48
50
60
70
72
76
78
80
82
84
86
88
90
92
94
104
106
108
110
112
114
116
118
122
124
126
128
132
134

INVALID LIFT AND TRANSPORT APPARATUS

SUMMARY OF THE INVENTION

This invention relates to an invalid lift and transport apparatus especially adapted for lifting an invalid from a sitting position to an elevated position, transporting the invalid if desired, and returning the invalid to a sitting position.

Invalid persons so disabled that they are unable on their own to stand or walk often require the assistance of two others to enable them to be moved from place to-place. To care for such an invalid at home can require more strength and agility than one or two people caring for such an individual may have. Often the task of transporting an invalid is so difficult that professional help or nursing home care is needed.

Conventional transport devices, such as wheelchairs or transport devices with slings on which the invalid is seated, are awkward to use for invalids incapable of self support. To move an invalid onto or off of such a device can require considerable strength and agility and can be dangerous for the invalid. Infections and foul odors from lack of proper hygienic care of the invalid's anal and genital areas commonly result from the use of the known transport devices and from the difficulty of properly cleaning these areas when the patient is either on a toilet seat or in a bed or chair.

An object of this invention is to provide a new and improved lift and transport apparatus for lifting and transporting an invalid. A further object of this invention is to provide such an apparatus that ordinarily will require the attendance of no more than one other person to lift and transport an invalid.

Still another object of this invention is to provide an invalid lift and transport apparatus for safely lifting an invalid to an elevated position in which the invalid's backside may be exposed for cleansing of the anal and genital areas.

In accordance with this invention, to safely lift an invalid to an elevated position in which the invalid's backside may be exposed for cleansing and in which the invalid may be transported over a floor, an invalid lift and transport apparatus is provided comprising a wheeled support having an upwardly projecting stanchion, an invalid support assembly comprising a support frame, invalid support means for supporting an invalid on the support frame, and means for clamping the invalid to the invalid support means. Mounting means are also provided for mounting the support frame on the stanchion for movement of the invalid support means from a first, lower position in which an invalid in a seated orientation may be engaged with and clamped, as by a strap or straps, to the invalid support means, to a second, elevated position in which the invalid is oriented in a generally prone position and supported by the invalid support means, and drive means are provided for moving the invalid support assembly between its two positions.

Further in accordance with this invention, the invalid support assembly includes shoulder support means mounted on the support frame for supporting the shoulders and upper arms of an invalid, trunk support means mounted on the support frame for supporting the thoracic and abdominal areas of the invalid including clamping means for removably clamping the trunk of the invalid thereto, and knee support means mounted on the support frame for supporting the knees and lower leg area of the invalid. A foot support member for supporting and confining the feet is preferably also provided.

The frame mounting means and the drive means for moving the invalid support assembly preferably provide an efficient mechanism for enabling an invalid in a seated orientation to be rapidly yet safely elevated and pivoted to a generally prone orientation. To this end, the frame mounting means of this invention comprises a first lever having a first end connected to the stanchion for pivotal movement about a first horizontal axis and a second end pivotally connected to the support frame, and further comprises a second lever having a first end connected to the stanchion for pivotal movement about a second horizontal axis which is higher than the first horizontal axis and the second lever has a second end pivotally connected to the support frame. The first and second levers cross one another between the stanchion and the support frame so that the second end of the second lever is located below the second end of the first lever. The drive means preferably includes first motive means for pivotally moving the second lever relative to the stanchion to raise and lower the invalid support assembly. The second lever includes a telescopically-movable first and second rigid parts fixed, respectively, to the stanchion and to the invalid support frame and the drive means preferably further includes second motive means for relatively moving the first and second parts to pivot the support frame about the second end of the first lever thereby to vary the angle of said support assembly relative to vertical.

Other objects and advantages will become apparent from the following description and the drawings.

DETAILED DESCRIPTION

Figure 1:
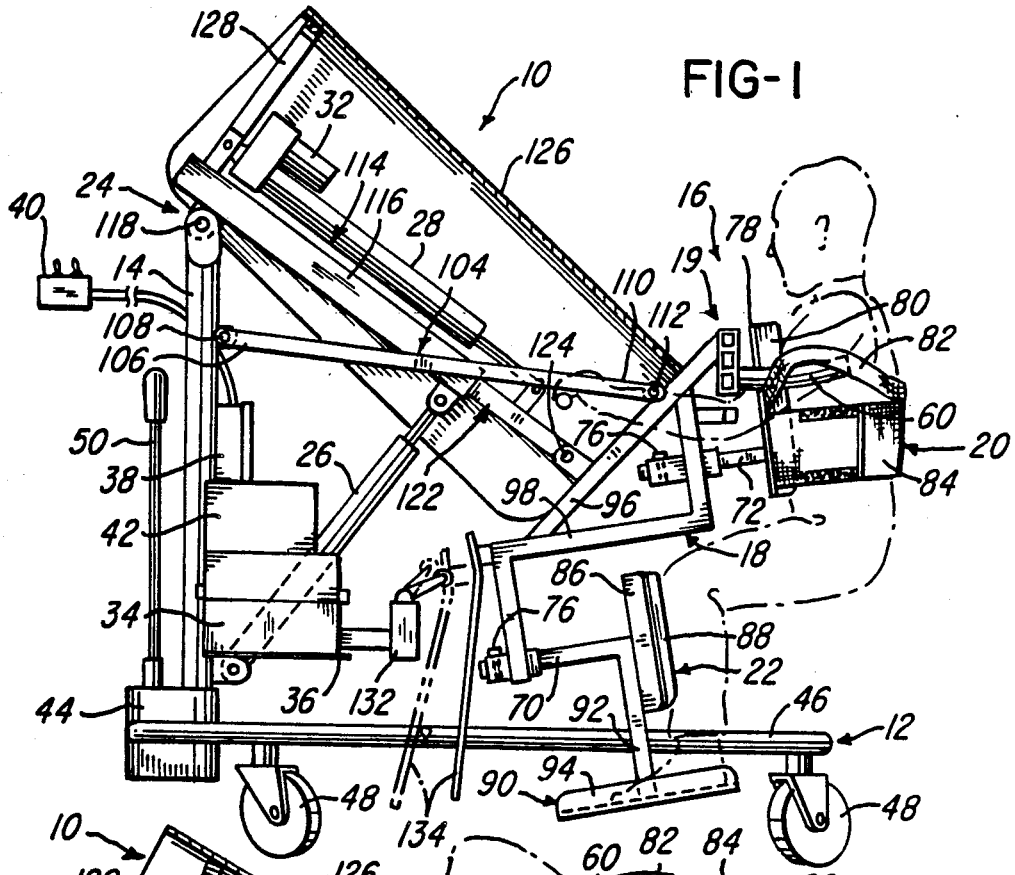
FIG. 1 is a fragmentary side elevational view, partly in cross section, of apparatus according to this invention showing the position of parts when an invalid is slightly elevated above a seated position and indicating by phantom lines the position of an invalid person clamped thereto.

With reference to the drawings, this invention is shown embodied in an invalid lift and transport apparatus, generally designated 10, for lifting an invalid from a sitting position to an elevated position and for transporting the invalid when lifted. The apparatus 10 comprises a wheeled support, generally designated 12, having an upwardly projecting, rigid stanchion 14, and an invalid support assembly, generally designated 16, comprising a support frame, generally designated 18, that carries invalid support means for supporting an invalid on the support frame 18. The invalid support means comprises a shoulder support subassembly, generally designated 19, mounted on the support frame 18 for supporting the upper arms and shoulders of an invalid, a trunk support subassembly, generally designated 20, mounted on the support frame 18 for supporting the thoracic and abdominal areas of the invalid, and a knee support subassembly, generally designated 22, mounted on the support frame 18 for supporting the knees and lower leg area of the invalid.

Figure 2:
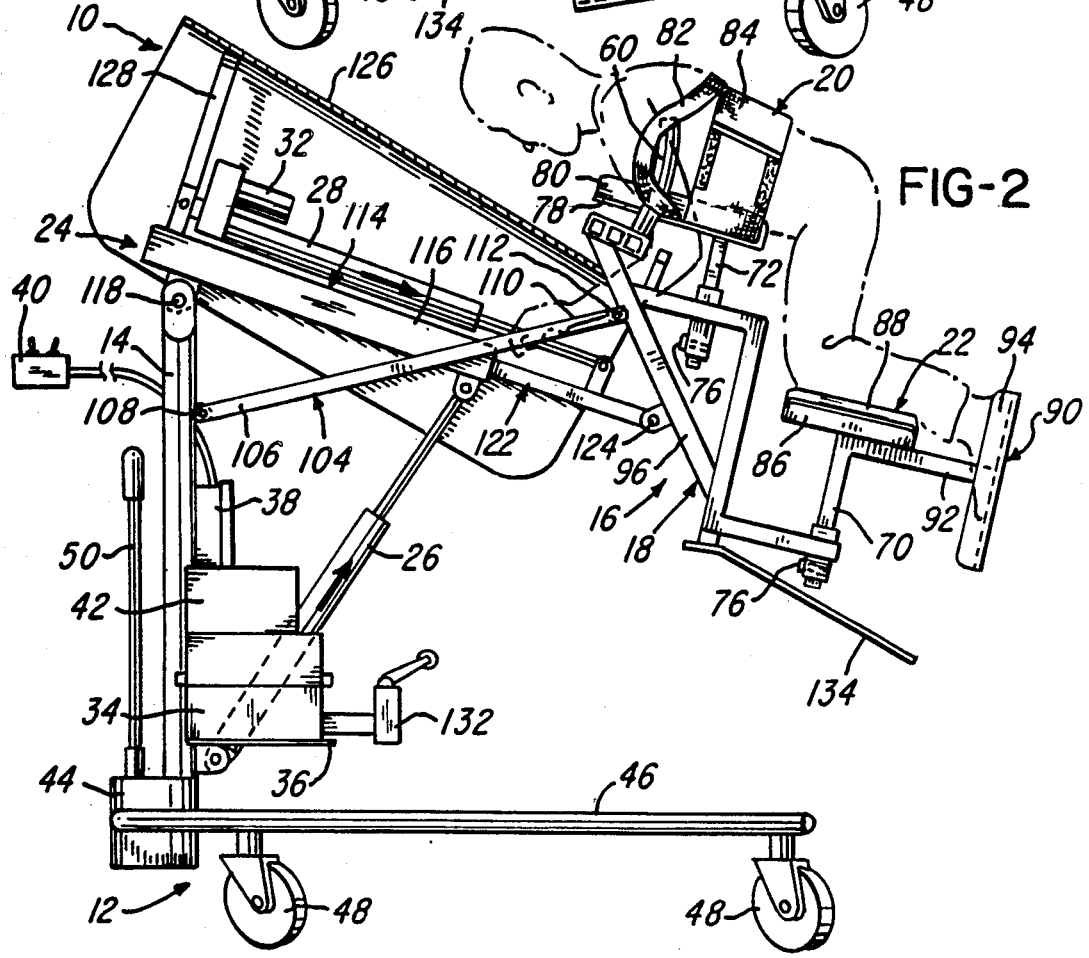
FIG. 2 is a view similar to FIG. 1 but showing the position of parts of the same apparatus when an invalid is elevated substantially above a seated position pivoted and tilted forwardly to a generally prone position and indicating by phantom lines the position of an invalid supported thereby.
Figure 3:
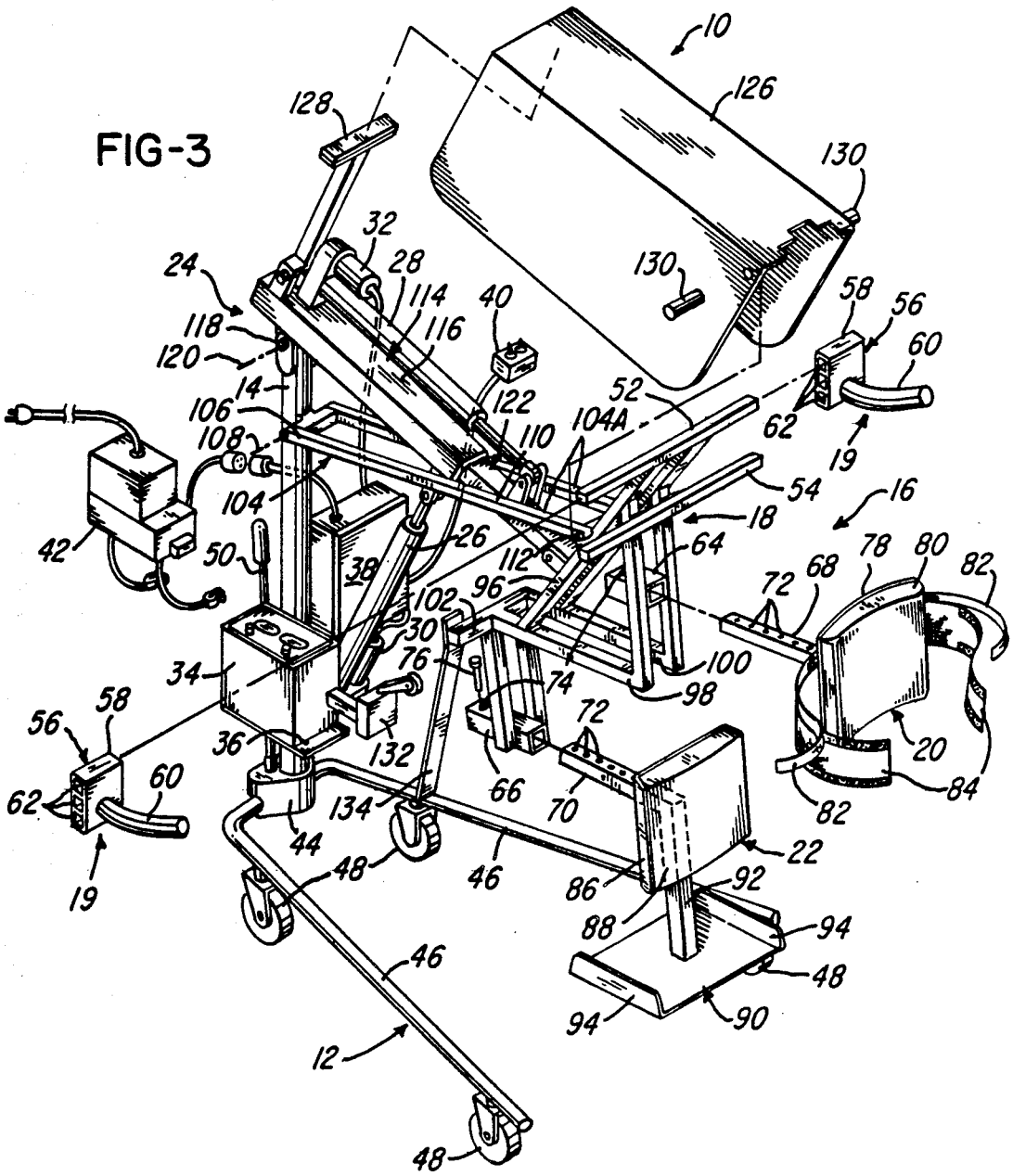
FIG. 3 shows a partly schematic, partly exploded, perspective view of the apparatus of FIGS. 1 and 2.

Mounting means, generally designated 24, supports the support assembly 16 in cantilever fashion from the stanchion 14, and power operated jacking units, namely a first jacking unit 26 and a second jacking unit 28, are provided for moving the support assembly 16 as desired. The jacking units 26 and 28 are preferably driven by electric motors 30 and 32, respectively, and powered by a battery 34 positioned on a battery support plate 36 mounted on the stanchion 14. Suitable controls (not shown) for the motors 30 and 32 may be located within a control housing 38 mounted on the stanchion 14 adjacent the battery 34. Remote control of the motors 30 and 32 is accomplished by a hand-held switch assembly 40 wired to the controls in the housing 38. As schematically indicated in FIG. 3, full charge of the battery 34 may be maintained by a battery charger 42 that may be plugged into ordinary house current when the apparatus 10 is not in use and carried on the battery 34 when the apparatus 10 is in use as shown in FIGS. 1 and 2.

Wheeled support 12 comprises a support housing 44 from which project a pair of horizontally-extending legs 46 supported by plural castors 48. To roll the apparatus 10 along a floor, a control handle 50 is pivotally mounted in the support housing 44, which handle may be pulled or pushed as desired. Those familiar with the art will recognize that the legs 46 may be spread apart to a greater or lesser extent by a mechanism (not shown) controlled by rotation of the top of the control handle 50 about its longitudinal axis. This enables one to spread the legs 46 to permit the invalid support assembly 16 to closely approach chairs or toilet seats yet bring the legs 46 together if needed to negotiate narrow halls or doorways. Although a mechanism for adjusting the spread of the legs 46 is preferably provided, the mechanism itself may be conventional and is not part of the present invention.

Stanchion 14 comprises a metal rod or post, that may be hollow, having sufficient strength to support an invalid and the invalid supporting mechanism of this invention. The stanchion 14 is mounted within a socket in the support housing 44 and supported by the base of the socket as will be understood by those familiar with wheeled supports of the type illustrated. For stability, the support assembly 16 is supported by the mounting means 24 in cantilever fashion over the area generally between the legs 46.

Support frame 18 comprises a rigid, unitary framework having a pair of laterally extending, mutually parallel, upper and lower, shoulder support rails 52 and 54, respectively, that are adapted to slidably support a right and left pair of underarm assemblies 56, each comprising a mounting block 58 and a padded underarm support rod 60. Here it should be noted that relative terms such as "upper", "lower", and terms of similar import are used in reference to parts of the support frame 18 when it is lowered as in FIG. 1. Each mounting block 58 has a vertical row of three holes 62, adapted to slide over one of the shoulder support rails 52 or 54. The combination of the three holes 62 and the two rails 52 and 54 enables the underarm assemblies 56 to be placed at any one of six different vertical locations on the support frame 18. Lock means (not shown), such as thumb screws, may be provided for locking the mounting blocks 58 in laterally adjusted positions on the support rails 52 or 54.

Support frame 18 further comprises a pair of horizontally and vertically spaced mounting members, namely an upper, trunk support mounting member 64 and a lower, knee support mounting member 66. These mounting members 64 and 66 may comprise short lengths of hollow, square tubing that respectively receive a trunk support mounting bar 68 and a knee support mounting bar 70. Each of the mounting bars 68 and 70 has a row of openings 72 adapted to be selectively aligned with openings 74 in their respective mounting members 64 and 66 and held by a connecting pin or key 76 extended through the aligned openings.

The trunk support subassembly 20 comprises, in addition to its mounting bar 68, a trunk support plate 78 covered by a pad 80 and mounted at the free end of the mounting bar 68 with the exposed face of the pad 80 facing away from the stanchion 14 and further comprises upper and lower straps 82 and 84. The lower strap 84 is adapted to be wrapped around the back of an invalid's trunk to clamp the invalid to the support plate 78 and the upper strap 82 is wrapped around the outside of the invalid's upper arms and the invalid's back to clamp the invalid's arms against the underarm support rods 60 and also to clamp the invalid to the support plate 78. Looped and hooked fabric material, such as sold under the trademark VELCRO, may be used to hold the opposite ends of the straps 82 and 84 together. Conventional buckles may be used instead.

Knee support subassembly 22 comprises a knee support plate 86 covered by a pad 88 and mounted at the end of the mounting bar 70 most remote from the stanchion 14 with the exposed face of the pad 88 facing away from the stanchion 14. A foot support plate 90 is affixed to the lower end of a vertical leg 92 depending from the the knee support mounting bar 70. Foot support plate 90 is provided with side guards 94 to prevent the invalid's feet from accidently slipping off the foot support plate 90 during use of the apparatus 10.

Support frame 18 is shown generally Z-shaped in side elevation with a sloping mounting leg 96 facing the stanchion 14. The frame 18 may be constructed from lengths of hollow metal tubing forming spaced apart, mutually parallel, side frames 98 and 100 that are held together by virtue of both being welded or otherwise affixed to the shoulder support rails 52 and 54 and the trunk and knee support mounting members 64 and 66, and also by a cross piece 102 spanning between the side frames 98 and 100. It should be understood that frame 18 as shown in the the drawings is merely representative of many possible constructions.

Frame mounting means 24 comprises a rigid, first lever 104 having a first end 106 connected to the stanchion 14 for pivotal movement about a first horizontal axis 108 and a second end 110 pivotally connected at 112 to the support frame 18. Frame mounting means 24 further comprises a second lever 114 comprising a rigid sleeve 116 connected to the top of stanchion 14 by a pivot assembly 118 for pivotal movement about a second horizontal axis 120 which is higher up the stanchion 14 than the first horizontal axis 108. The second lever 114 further includes a rigid adjusting bar 122 having one end telescopically received within the sleeve 116 and another end pivotally connected at 124 to the support frame 18. The first and second levers 104 and 114 cross one another between the stanchion 14 and the support frame 18 so that the point of connection at 124 of the second lever 114 to the frame 18 is located below the point of connection at 112 of the first lever 104 to the frame 18. To permit the two levers 104 and 114 to cross one another, the first lever 104 is formed from a pair of spaced, mutually parallel lever arms 104A between which the second lever 114 extends.

First jacking unit 26 is pivotally connected to the stanchion 14 near its base and pivotally connected to the outer end of the sleeve 116 of the second lever 114 and is used to pivot the second lever 114 about its horizontal axis 120 of connection to the stanchion 14 to raise and lower the support assembly 16. Since the two levers 104 and 114 are connected at different points to the stanchion 14 and the support frame 16, pivotal movement of the second lever 114 under the control of the first jacking unit 26 will necessarily cause a resultant pivotal movement of the support frame 18 about its point 112 of pivotal connection to the first lever 104. Such resultant pivotal movement of the frame 18 causes the invalid support assembly 16 to pivot in a counterclockwise direction, as viewed in FIGS. 1 and 2, when the invalid support assembly 16 is elevated and in a clockwise direction when lowered. However, the speed and extent of such resultant pivotal movement is inadequate to satisfactorily lift and lower an invalid for purposes of this invention. Accordingly, the second jacking unit 28 is operated in effect to lengthen the second lever 114 when the invalid is first lifted and to shorten the second lever 114 when the invalid is lowered. Changing the length of the second lever 114 causes the support frame 18 to rotate about its point of connection at 112 to the first lever 104 whereupon an invalid clamped to the support assembly 16 may, while first being elevated under control of the first jacking unit 26, be rapidly moved to a generally prone position in which the invalid is supported by the trunk support subassembly 20 and the knee support subassembly 22 as is shown in FIG. 2.

To shield the invalid from the moving parts of the levers 104 and 114 and the jacking units 26 and 28, a guard shield 126 covers those parts of the levers and the jacking units that might accidentally be contacted in the absence of the shield 126. Shield 126 is pivotally connected by any suitable means to the support frame 18 at the same point 124 at which the second lever 114 is connected to the suppport frame 18 and slidably mounted on top of a support post 128 mounted on the end of the sleeve 116 over the stanchion 14, as can be observed from a comparison of the different positions of the shield 126 relative to the support post 128 in FIGS. 1 and 2. Hand grips 130 project from both sides of he shield 126 which the invalid may grip for a greater sense of security.

In operation, an invalid to be lifted or transported is brought to a sitting position and the apparatus 10 so positioned that the invalid can be clamped to the trunk support assembly 20 by the straps 82 and 84. If not previously adjusted for the particular physique of the invalid, the shoulder, trunk, and knee support subassemblies can be adjusted while the patient is still seated. The apparatus 10 is then moved away from the invalid's seat and the first jacking unit energized to begin elevating the invalid. During this time the invalid may lean forward to become partly supported by the trunk support plate 78 and the knee support plate 86 as well as the foot support plate 90, but the invalid is primarily supported by the straps 82 and 84 and by the underarm support rods 60. As quickly as possible, the second jacking unit 28 is energized to rapidly pivot the invalid to the generally prone position shown in FIG. 2 in which the invalid is supported by the trunk support plate and the knee support plate. The invalid may be cleansed while in the elevated, prone position, and may be moved about under the control of the handle 50. When the invalid is to be lowered, the first jacking unit 26 is preferably energized to lower the support assembly 18 while the patient remains somewhat prone. The second jacking unit 28 is energized to effectively shorten the second lever 114 just before the invalid is fully lowered. With practice, an attendant can quickly learn how to safely and comfortably lift and transport a patient using the apparatus 10.

As a precaution, a sensing switch 132 is provided in the path of a switch operator 134 suspended from the support frame 18. The switch 132 is effective to disable the electrical circuit to prevent further operation of the jacking units 26 and 28 to prevent excessive lowering or clockwise movement of the support assembly 16.

The stanchion 14 is considered to be part of the wheeled support 12 when the apparatus 10 is assembled but, because the stanchion 14 is slidably removable from the support housing 44, the apparatus 10 is easily separated into two sections for convenience in transporting the apparatus 10, one section comprising the stanchion 14 and the operating parts of the apparatus 10 mounted thereon, the other section comprising the rest of the wheeled support 12, namely the support housing 44, the legs 46, the castors 48, and the control handle 50.

While the drive means for moving the support assembly 16 preferably comprises electrically operated jacking units, as illustrated, it will be readily apparent that other drive means, including manually operated jacking units, may be used instead.

Although the presently preferred embodiment of this invention has been described, it will be understood that within the purview of this invention various changes may be made within the scope of the appended claims.

I claim:

1. An invalid lift and transport apparatus for lifting an invalid from a sitting position to an elevated position and for transporting the invalid, said apparatus comprising:

a wheeled support having an upwardly projecting stanchion;

an invalid support assembly comprising a support frame, shoulder support means mounted on said support frame for supporting the shoulders and upper arms of an invalid, trunk support means mounted on said support frame for supporting the thoracic and abdominal areas of the invalid including clamping means for removably clamping the trunk of the invalid thereto, and knee support means mounted on said support frame for supporting the knees and lower leg area of the invalid;

means mounting said invalid support assembly on said stanchion for movement of said assembly from a first, lower position in which an invalid in a seated orientation may be clamped to said trunk support means to a second, elevated position in which the entire body of the invalid is elevated and oriented in a generally prone position supported from beneath by both said trunk support means and said knee support means; and drive means for moving said support assembly between said two positions.

2. The apparatus of claim 1 wherein said trunk support means comprises padded chest support means for supporting the thoracic and abdominal areas of the invalid and a pair of padded underarm support means for engaging beneath the armpits of the invalid for supporting the invalid's shoulder area.

3. The apparatus of claim 2 wherein said padded chest support means and said padded underarm support means are adjustably mounted on said frame.

4. The apparatus of claim 2 wherein said clamping means comprises strapping means attached to said padded chest support means which may be wrapped around the back of the invalid for securing the invalid to said padded chest support.

5. The apparatus of claim 4 wherein said clamping means comprises additional strapping means attached to said padded chest support means which may be wrapped around the upper arms of the invalid for securing the invalid to said underarm support means.

6. The apparatus of claim 1 wherein said knee support means comprises a padded knee support plate adjustably mounted on said frame.

7. The apparatus of claim 1 wherein said invalid support assembly further comprises foot support means mounted on said frame for supporting the invalid's feet.

8. The apparatus of claim 1 wherein said support assembly mounting means comprises a first lever having a first end connected to said stanchion for pivotal movement about a first horizontal axis and a second end pivotally connected to said support frame, and a second lever having a first end connected to said stanchion for pivotal movement about a second horizontal axis which is higher than said first horizontal axis and said second lever having a second end pivotally connected to said support frame, said first and second levers crossing one another between said stanchion and said support frame so that said second end of said second lever is located below said second end of said first lever, and wherein said drive means includes motive means for pivotally moving said second lever relative to said stanchion to raise and lower said support assembly.

9. The apparatus of claim 8 wherein one of said levers comprises a pair of spaced lever arms and the other of said levers extends between said lever arms.

10. The apparatus of claim 8 wherein said second lever includes a first rigid part fixed to said stanchion for pivotal movement about said second horizontal axis, wherein said second lever further includes a second rigid part movable relative to said first part in the direction of the longitudinal axis of said second lever, and said drive means further includes second motive means for relatively moving said first and second parts to pivot said support frame about the second end of said first lever thereby to vary the angle of said support assembly relative to vertical.

11. The apparatus of claim 10 wherein said first part of said second lever telescopically receives said second part of said second lever.

12. The apparatus of claim 10 wherein said first mentioned motive means and said second motive means comprise, respectively, a first jacking means and a second jacking unit.

13. The apparatus of claim 12 wherein said first jacking unit is pivotally connected to said wheeled support and to said first part of said second lever and said second jacking unit is connected to said first part of said second lever and to said second part of said second lever.

14. The apparatus of claim 13 further including a protective shield connected to said second end of said first lever and overlying said second lever and said second jacking unit.

15. The apparatus of claim 14 further including a pair of hand grips projecting laterally from said shield.

16. The apparatus of claim 10 wherein each of said motive means is electrically-powered.

17. The apparatus of claim 16 further including means for supporting a battery on said wheeled support for supplying electrical energy to said motive means.

18. An invalid lift and transport apparatus for lifting an invalid from a sitting position to an elevated position and for transporting the invalid, said apparatus comprising:

a wheeled support having an upwardly projecting stanchion;

an invalid support assembly comprising a support frame, invalid support means for supporting an invalid on said support frame, said support means having spaced invalid-engaging surfaces adapted to support the upper body and the lower legs of an invalid, and means for clamping the invalid to at least one of said invalid support surfaces;

means mounting said invalid support frame on said stanchion for movement of said support assembly from a first, lower position in which an invalid in a seated orientation may be engaged with both of said invalid-engaging surfaces and clamped to at least one of said invalid-engaging surfaces to a second, elevated position in which the entire body of the invalid is elevated and oriented in a generally prone position and supported in said elevated and generally prone position on said invalid-engaging surfaces, said frame mounting means including a lever having a first end pivotally connected to said stanchion for pivotal movement about a first horizontal axis and a second end pivotally connected to said support frame; and drive means for moving said invalid support assembly between said first position and said second position including a first mechanism for raising and lowering said support frame and a second mechanism for pivoting said support frame relative to said second end of said lever.

19. The apparatus of claim 18 wherein said frame mounting means further comprises a second lever having a first end connected to said stanchion for pivotal movement about a second horizontal axis which is higher than said first horizontal axis and said second lever having a second end pivotally connected to said support frame, said first mentioned lever and said second lever crossing one another between said stanchion and said support frame so that said second end of said second lever is located below said second end of said first mentioned lever, and wherein said first mechanism includes motive means for pivotally moving said second lever relative to said stanchion to raise and lower said support assembly.

20. The apparatus of claim 19 wherein one of said levers comprises a pair of spaced lever arms and the other of said levers extends between said lever arms.

21. The apparatus of claim 19 wherein said second lever includes a first rigid part fixed to said stanchion for pivotal movement about said second horizontal axis, wherein said second lever further includes a second rigid part movable relative to said first part in the direction of the longitudinal axis of said second lever, and said second mechanism includes second motive means for relatively moving said first and second parts to pivot said support frame about the second end of said first mentioned lever thereby to vary the angle of said support assembly relative to vertical.

22. The apparatus of claim 21 wherein said first part of said second lever telescopically receives said second part of said second lever.

23. The apparatus of claim 21 wherein each of said motive means is electrically-powered.

24. The apparatus of claim 23 further including means for supporting a battery on said wheeled support for supplying electrical energy to said motive means.

25. The apparatus of claim 19 wherein said first mentioned motive means and said second motive means comprise, respectively, a first jacking unit and a second jacking unit.

26. The apparatus of claim 25 wherein said first jacking unit is pivotally connected to said wheeled support and to said first part of said second lever and said second jacking unit is connected to said first part of said second lever and to said second part of said second lever.

27. Lift apparatus for lifting an invalid from a sitting position to an elevated position, said apparatus comprising:

a support having an upwardly projecting stanchion;

a support assembly comprising a support frame and invalid support means for supporting an invalid on said support frame, said support means having spaced invalid-engaging surfaces adapted to support the upper body and the lower legs of an invalid;

means mounting said invalid support frame on said stanchion for movement of said support assembly from a first, lower position in which an invalid in a seated orientation may be engaged with both of said invalid-engaging surfaces to a second, elevated position in which the entire body of the invalid is elevated and oriented in a generally prone position and supported in said elevated and generally prone position on said invalid-engaging surfaces, said frame mounting means including a lever having a first end pivotally connected to said stanchion for pivotal movement about a first horizontal axis and a second end pivotally connected to said support frame; and drive means for moving said invalid support assembly between said first position and said second position including a first mechanism for raising and lowering said support frame and a second mechanism for pivoting said support frame relative to said second end of said lever.

28. The apparatus of claim 27 wherein said frame mounting means further comprises a second lever having a first end connected to said stanchion for pivotal movement about a second horizontal axis which is higher than said first horizontal axis and said second lever having a second end pivotally connected to said support frame, said first mentioned lever and said second lever crossing one another between said stanchion and said support frame so that said second end of said second lever is located below said second end of said first mentioned lever, and wherein said first drive mechanism includes motive means for pivotally moving said second lever relative to said stanchion to raise and lower said support assembly.

29. The apparatus of claim 28 wherein one of said levers comprises a pair of spaced lever arms and the other of said levers extends between said lever arms.

30. The apparatus of claim 28 wherein said second lever includes a first rigid part fixed to said stanchion for pivotal movement about said second horizontal axis, wherein said second lever further includes a second rigid part movable relative to said first part in the direction of the longitudinal axis of said second lever, and said second mechanism includes second motive means for relatively moving said first and second parts to pivot said support frame about the second end of said first mentioned lever thereby to vary the angle of said support assembly relative to vertical.

* * * * *